US006413101B2

(12) United States Patent
Divoll et al.

(10) Patent No.: US 6,413,101 B2
(45) **Date of Patent: *Jul. 2, 2002**

(54) POWER OUTLET ADAPTER

(75) Inventors: Stephan R. Divoll, North Attleboro; John E. Truesdell, Westborough, both of MA (US)

(73) Assignee: Joseph Pollak Corporation, Boston, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/497,936

(22) Filed: Feb. 4, 2000

Related U.S. Application Data

(60) Provisional application No. 60/119,318, filed on Feb. 9, 1999.

(51) Int. Cl.[7] ..... H01R 23/02
(52) U.S. Cl. ..... 439/35; 439/651; 439/638
(58) Field of Search ..... 439/638, 35, 561

(56) References Cited

U.S. PATENT DOCUMENTS

| | | | | |
|---|---|---|---|---|
| 4,770,644 | A | 9/1988 | Feder | 439/166 |
| D331,223 | S | 11/1992 | Hughes | D13/147 |
| 5,184,960 | A | 2/1993 | Hopkins et al. | 439/35 |
| D335,122 | S | 4/1993 | Hughes | D13/146 |
| 5,281,147 | A | 1/1994 | Hughes | 439/35 |
| 5,354,204 | A | 10/1994 | Hughes | 439/35 |
| 5,442,332 | A | 8/1995 | Hughes | 340/467 |
| 5,443,389 | A | 8/1995 | Hughes | 439/35 |
| D366,240 | S | 1/1996 | Kittridge | D13/146 |
| D370,204 | S | 5/1996 | Kittridge | D13/146 |
| 5,514,009 | A | 5/1996 | Hughes | 439/35 |
| D375,905 | S | 11/1996 | Kittridge | D10/78 |
| 5,626,479 | A | 5/1997 | Hughes | 439/35 |

*Primary Examiner*—P. Austin Bradley
*Assistant Examiner*—Alexander Gilman
(74) *Attorney, Agent, or Firm*—Grossman, Tucker, Perreault & Pfleger, PLLC

(57) ABSTRACT

A unitary adapter for vehicular use for transferring power from a multi-contact connector socket to a 2-terminal power outlet in which individual components are assembled without wired connections. At one end of the adapter is a base serving as a plug for insertion in a connector socket, two of said multi-contacts being in circuit with a power source in said vehicle. At the other end of the adapter two output terminals are disposed, one disposed centrally of a cylindrical sleeve and the second disposed upon said sleeve and carrying a spring-biased lead urged against one of said contacts in circuit with said power source.

2 Claims, 2 Drawing Sheets

POWER OUTLET ADAPTER

This application claims benefit of 60/119,318 filed Feb. 9, 1999.

This invention relates in general to an adapter for transferring power from a multi-contact connector socket to a 2-terminal power outlet, and in particular to a unitary adapter consisting of an assembly of individual components having no wired connections.

BACKGROUND OF THE INVENTION

It has become commonplace to provide connector sockets on a towing vehicle, which sockets accept plugs cable-connected to electrical components of a towed vehicle. The connector socket is usually recessed and has a hinged cover to keep moisture and contamination out when no plug is inserted in the socket. Because of the multiplicity of components in current vehicles for such things as running lights, brake lights, and signal lights, as well as electric brakes and other auxiliary equipment, the connector socket may have as many as six contact terminals arrayed in a circular pattern about a central terminal. There have been developed adapters for power outlets which consist of a matching plug for the connector socket and a loop of multi-conductor cable running to a socket which matches the plug of the appliance. These adapters have generally been satisfactory, but are somewhat inconvenient because the loop of cable which is required tends to interfere with other equipment or become dislodged. Also, when not in use, unless the adapter is removed, the plug hangs from the towing vehicle in an unsightly fashion.

It is the primary object of the present invention to avoid the difficulties and inconvenience associated with cabled adapters.

It is a further object of the present invention to provide a reliable unitary adapter to transfer power from a multi-contact socket to a dual contact power outlet. A further object is to make conveniently available a source of DC power at the rear of a towing vehicle for auxiliary equipment such as TV sets, electric coolers, car vacuums, spot lights, and the like.

SUMMARY OF THE INVENTION

The present invention is organized about the concept of providing components of rugged construction assembled as a unit in a cylindrical adapter body. At one end of the body, there is a an adapter base serving as multi-contact plug for insertion in a vehicle connector socket. The plug has two active terminals designed to mate with two corresponding active contacts in the vehicle connector socket which in turn are connected to the battery of the vehicle.

At the other end of the adapter body, there is a cylindrical output can terminal which carries a spring-biased lead extended into the adapter base to form one of the power contacts for the connector plug. A second output terminal held centrally of the output can terminal also extends into the adapter base in which it forms the second power contact of the connector plug.

For a better understanding of the present invention, together with other and further objects, features and advantages, reference should be made to the following description of a preferred embodiment which should be read with reference to the appended drawing in which.

DESCRIPTION OF PREFERRED EMBODIMENT

Figure 1:
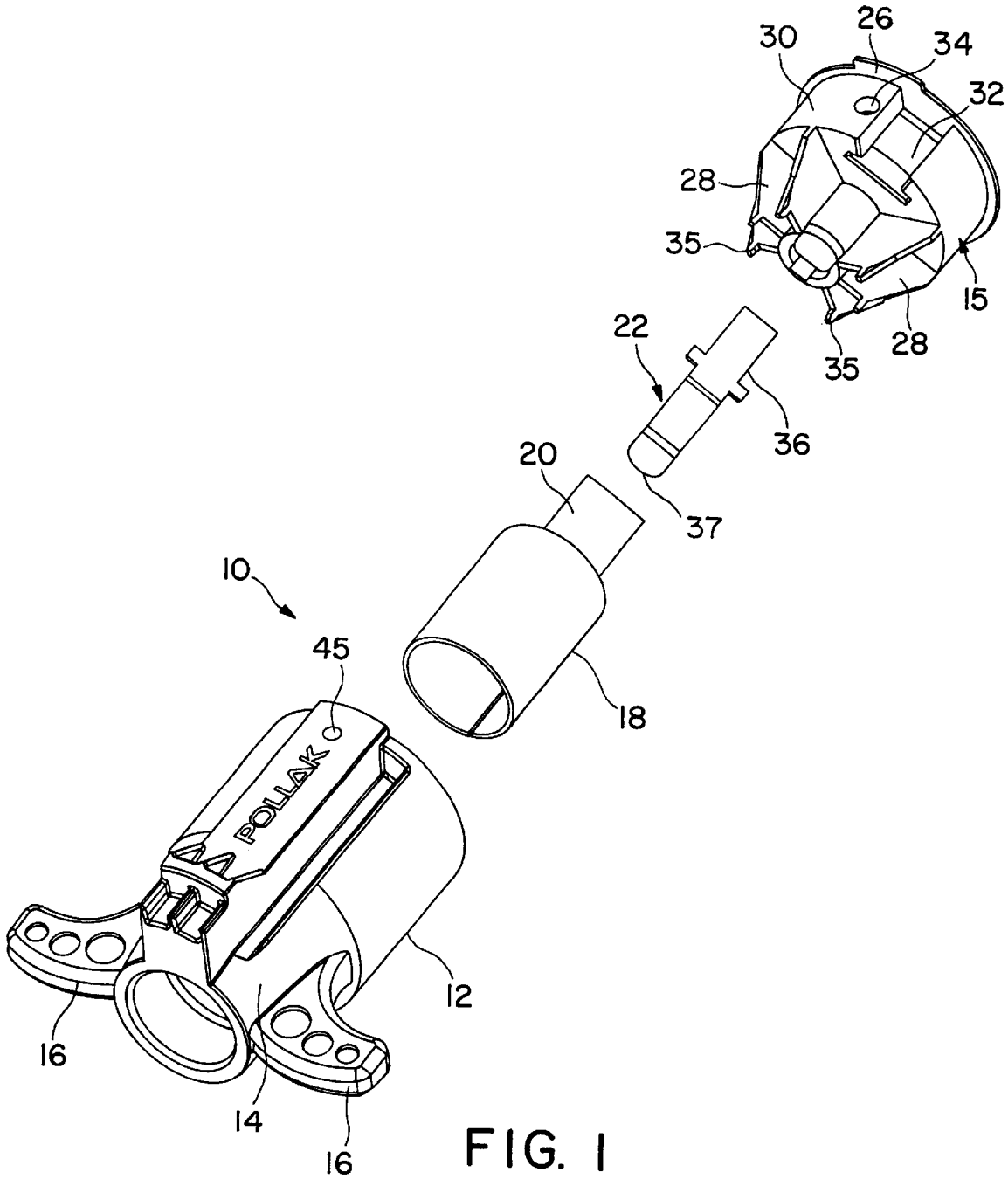
FIG. 1 is an exploded view of an adapter made in accordance with the present invention.

FIG. 1 illustrates, in exploded view, a trailer power outlet adapter 10 consistent with the invention including a cylindrical adapter body 12, in one end of which an adapter base 15 is inserted. The outer end of the base 15 is configured as a plug to fit the connector socket of a towing vehicle. The body includes a conical section 14 on which diametrically opposite finger grips 16 are mounted. An output can terminal 18 is mounted on the base and has a contact extension 20 extending into a peripheral opening 32 formed in the base. An output center terminal 22 is held in a central position relative to the can terminal 18 by the base 15. The adapter base 15 has a flanged keyed end 26 which includes a cylindrical portion 30 and a series of radial ribs 28 tapered inwardly. The portion 30 is fitted into the body 12 of the adapter 10. In the portion 30, additional peripheral slots similar to the opening 32 are formed, as is a set-screw receiving opening 34.

Figure 2A:
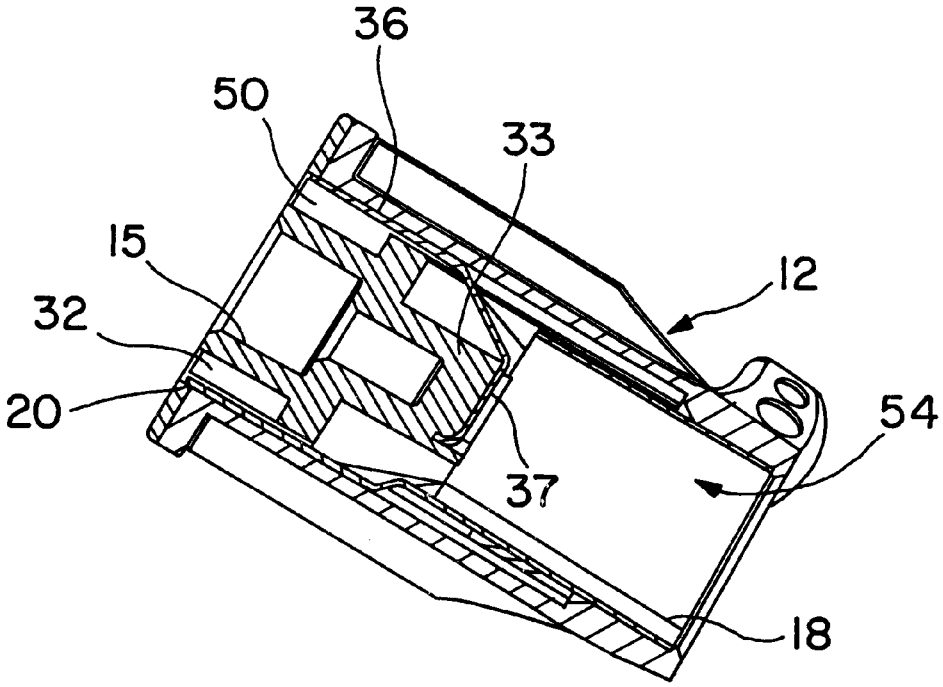
FIG. 2(A) is a view in section of the adapter body and base.
Figure 2B:
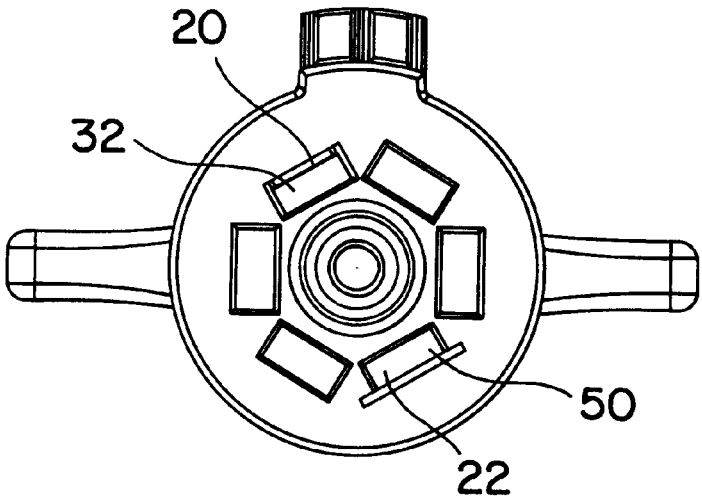
FIG. 2(B) is an end view of the power outlet of the adapter.

In FIGS. 2(A) and (B), greater detail on the adapter base 15 and its relation to the adapter body 12 is shown. Like the adapter body 12, the base is preferably formed of a plastic such as high-impact polypropylene. The base 15, as noted above, has a cylindrical portion 30 which fits closely into one end of the adapter body. The radial ribs 28 terminate at their inner ends in tips 35. The tips 35 define a circle which locates and provides support to the output can terminal 18 in which the tips are confined. In addition, the central terminal 22, which is generally L-shaped, has a longer leg 36 extending into a slotted axial opening 50 in the base 15 and a shorter leg 37 disposed centrally and radially of the unit. The shorter leg 37 of the central contact 22 is fitted on the innermost portion 33 of the adapter base which projects toward the center of the can terminal 18. The longer leg 36 is biased outwardly in the opening 50. Diametrically opposite the axial slot 50 is the opening 32 into which the contact extension 20 projects. The end view of FIG. 2(B) illustrates the positions of the two contacts 20, 22 in their respective openings 32, 50 of the plug. It will be noted that they are biased toward the outer wall of the plug to assure good contact with their mating elements in the vehicle socket, which elements are connected to the battery or other power source in the towing vehicle.

At the other end of the adapter body, an output socket 54 of the so-called "cigarette lighter" type is formed by the can terminal 18 and the center terminal 22.

The adapter is assembled by first mounting the terminals on the adapter base 15. Then, the mounted assembly is inserted into the body of the adapter, which has a radial opening (not shown) through which a set screw may be tightened into the opening 34 of the cylindrical portion 30 of the base 15 to maintain the adapter in assembled form. A matching radial opening 45 is formed in the adapter body.

Alternatively, rather than mechanically assembling the components, the can terminal 18 and the center terminal 22 may be over-molded with a plastic or rubber type material.

What is claimed is:

1. A trailer power outlet adapter for providing power to a plug from a multi-contact socket mounted on a vehicle and having at least two contacts connected to a power source in said vehicle, said adapter comprising: an adapter body; an adapter base fitted into one end of said adapter body; a one-piece cylindrical can output terminal; and a one piece center output terminal having at least one protrusion extending therefrom; said adapter base comprising an outer end matching said socket and having axial openings therein along the perimeter of said base for receiving said contacts of said socket, said can output terminal comprising an integral contact extension extending therefrom and into a first one of said axial openings for making electrical contact with one of said contacts of said multi-contact socket, said center output terminal having a first portion extending into another of said axial openings, diametrically opposed to said first axial opening, for making electrical contact with another of said contacts of said multi-contact socket and a second portion substantially orthogonal to said first portion for making direct contact with a center terminal of said plug, said second portion retained centrally of said can terminal by engagement of said at least one protrusion with said base, said center output terminal and said can terminal being insulated from each other by said base.

2. A trailer power outlet adapter as defined in claim 1, wherein said adapter body and said adapter base comprise high-impact plastic, wherein said one piece cylindrical can output terminal comprises a metallic sleeve having an end mounted on said base, and wherein said one piece center output terminal is generally L-shaped, a relatively long leg of said one piece center output terminal comprising said first portion and a relatively short leg of said center output terminal comprising said second portion.

* * * * *